US005314073A

United States Patent [19]

Sharma et al.

[11] Patent Number: 5,314,073

[45] Date of Patent: May 24, 1994

[54] PHOSPHATE FLOTATION USING SULFO-POLYESTERS

[75] Inventors: Mahendra K. Sharma, Kingsport, Tenn.; George J. O'Neill, Osaka, Japan; Brij M. Moudgil, Gainesville, Fla.

[73] Assignee: Eastman Kodak Company, Rochester, N.Y.

[21] Appl. No.: 55,595

[22] Filed: May 3, 1993

[51] Int. Cl.[5] ..... B03D 1/016; B03D 1/02

[52] U.S. Cl. ..... 209/166; 209/167; 252/61

[58] Field of Search ..... 209/166, 167, 902; 252/61

[56] References Cited

U.S. PATENT DOCUMENTS

| | | | |
|---|---|---|---|
| 3,164,549 | 1/1965 | Seymour | 209/166 |
| 4,034,863 | 7/1977 | Wang | 209/166 |
| 4,172,029 | 10/1979 | Hefner | 209/166 |
| 4,301,003 | 11/1981 | Hsieh . | |
| 4,482,480 | 11/1984 | Bresson . | |
| 4,687,571 | 8/1987 | Kari . | |
| 4,719,009 | 1/1988 | Furey et al. | 209/167 |
| 4,755,285 | 7/1988 | Weckman . | |
| 4,814,070 | 3/1989 | Koester . | |
| 5,015,367 | 5/1991 | Klimpel . | |
| 5,147,528 | 9/1992 | Bulatovic . | |
| 5,171,427 | 12/1992 | Klimpel . | |
| 5,173,176 | 12/1992 | Klimpel . | |

*Primary Examiner*—Thomas M. Lithgow

*Attorney, Agent, or Firm*—John D. Thallemer; William P. Heath, Jr.

[57] ABSTRACT

This invention relates to a process for beneficiating a silicious phosphate ore by flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a water dispersible sulfo-polyester having a glass transition temperature of 28° C. to 60° C. and consisting essentially of repeat units from a dicarboxylic acid, a diol and a difunctional sulfomonomer.

19 Claims, No Drawings

PHOSPHATE FLOTATION USING SULFO-POLYESTERS

FIELD OF THE INVENTION

This invention relates to a process for beneficiating a silicious phosphate ore by flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a water dispersible sulfo-polyester having a glass transition temperature of 28° C. to 60° C. and consisting essentially of repeat units from a dicarboxylic acid, a diol and a difunctional sulfomonomer.

BACKGROUND OF THE INVENTION

Florida accounts for more than 80% of the phosphate rock used in the United States and 30% of the world phosphate rock production. Each year more than 100 million tons of material is floated to generate 40–45 million tons of phosphate concentrate. Florida phosphate ore is known as matrix and consists of equal proportions of fluorapatite (a calcium phosphate containing fluorine), silica gangue and clays. Clays are separated from the matrix by washing and sizing leaving a phosphate and silica mixture. A three step process is used for separating phosphate from silica. In the first step, phosphate is separated from silica using a fatty acid and fuel oil mixture as a collector. The collector selectively coats the phosphate making it hydrophobic. When air is bubbled through the phosphate and silica suspension, the hydrophobic phosphate particles attach to the air bubbles and rise to the top where they are skimmed off. This method is known as rougher flotation. Silica is removed as a sink fraction and constitute rougher tailings. In the second step, the fatty acid and fuel oil layer are scrubbed off the phosphate particles by intense agitation and adjusting the pH to about 3. The treated material is washed until the pH is restored to a value of about 7. In the third step, fatty amine collectors are added to further reduce the amount of silica by rendering the surface of the silica hydrophobic leaving the phosphate hydrophilic. The floated silica particles constitute the froth whereas the phosphate particles sink and are referred to as the concentrate.

U.S. Pat. No. 3,164,549 discloses a process for beneficiating phosphate ores by froth flotation utilizing dodecyl benzene sulfonic acid. U.S. Pat. No. 4,034,863 discloses a process for beneficiating phosphate ores by froth flotation utilizing certain partial esters of a polycarboxylic acid. U.S. Pat. No. 4,172,029 discloses a process for beneficiating phosphate ores by froth flotation utilizing sulfonated aromatic compounds such as alkylated diphenyl ether sulfonate. However, the aforementioned patented flotation processes have not been of commercial value. The limited increased phosphate recovery effected by these processes is more than offset by the higher cost of the reagents relative to those used in the conventional process.

U.S. Pat. No. 4,719,009 discloses a process for concentrating zinc sulfide from complex sulfide ores containing siliceous gangue materials utilizing a depressant containing ether groups and metal sulfonate groups. The depressant is effective in an amount as low as 0.03 kg/ton of ore feed for the recovery of zinc sulfide concentrate. U.S. Pat. No. 4,719,009 is concerned with purifying zinc not increasing the yield of zinc. The sulfo-polyester acts to suppress silica. In phosphate flotation, on the other hand, the sulfo-polyester increases the phosphate yield without suppressing the silica. It is important to note that depressants are often found to be effective only in the treatment of certain specific ores due to the presence of salts in the water, the characteristics of ionic impurities associated with the siliceous gangue materials and other empirical factors, poorly understood.

The present inventors have unexpectedly determined that the addition of at least 0.6 kg/ton of a water dispersible, water dissipatable sulfo-polyester having a glass transition temperature (Tg) of 28° C. to 60° C. to a process for beneficiating a silicious phosphate ore by froth flotation increases the yield of phosphate.

SUMMARY OF THE INVENTION

It is therefore an object of the present invention to provide a process for recovering phosphate from mining ores.

Another object of the invention is to provide a process for beneficiating a silicious phosphate ore by employing water dispersible sulfo-polyesters.

These and other objects are accomplished herein by a process for beneficiating a silicious phosphate ore by froth flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a water dispersible sulfo-polyester having a glass transition temperature of 28° C. to 60° C., said sulfo-polyester consisting essentially of repeat units from:

(a) a dicarboxylic acid selected from the group consisting of aromatic dicarboxylic acids, saturated aliphatic dicarboxylic acids, cycloaliphatic dicarboxylic acids, and combinations thereof;

(b) a diol; and (c) a difunctional sulfomonomer containing at least one sulfonate group attached to an aromatic nucleus wherein the functional groups are hydroxy, carboxy or amino, provided the difunctional sulfomonomer is present in an amount from 12 to 25 mole percent based on 100 mole percent dicarboxylic acid and 100 mole percent diol.

DESCRIPTION OF THE INVENTION

The sulfo-polyester which is utilized as a phosphate flotation additive in the practice of this invention is a water dispersible or water-dissipatable, linear polyester having a Tg value of 28° C. to 60° C. The term "water dispersible" is used interchangeably with other descriptors such as "water dissipatable" or "water dispellable". All of these terms refer to the activity of water or a mixture of water with a water-miscible organic solvent on the sulfo-polyesters described herein. This terminology includes conditions where the sulfo-polyester is dissolved to form a true solution or is dispersed within an aqueous medium. Due to the statistical nature of polyester compositions, it is possible to have soluble and dispersible fractions when a single polyester is acted upon by an aqueous medium.

The sulfo-polyester contains repeat units from a dicarboxylic acid and a difunctional sulfomonomer, and a diol. Dicarboxylic acids useful in the present invention include aromatic dicarboxylic acids having 8 to 14 carbon atoms, saturated aliphatic dicarboxylic acids having 4 to 12 carbon atoms, and cycloaliphatic dicarboxylic acids having 8 to 12 carbon atoms. Specific examples of dicarboxylic acids are: terephthalic acid, phthalic acid, isophthalic acid, naphthalene-2,6-dicarboxylic acid, cyclohexanedicarboxylic acid, cyclohexanediacetic acid, diphenyl-4,4'-dicarboxylic acid, succinic acid, glutaric acid, adipic acid, azelaic acid, sebacic acid, and the like. The sulfo-polyesters may be prepared from two or more of the above dicarboxylic acids.

It should be understood that use of the corresponding acid anhydrides, esters, and acid chlorides of these acids is included in the term "dicarboxylic acid".

The difunctional sulfomonomer component of the polyester may be a dicarboxylic acid or an ester thereof containing a metal sulfonate group ($-SO_3^-$), a diol containing a metal sulfonate group, or a hydroxy acid containing a metal sulfonate group. Suitable metal cations of the sulfonate salt may be $Na^+$, $Li^+$, $K^+$, $Mg^{++}$, $Ca^{++}$, $Ni^{++}$, $Fe^{++}$, $Fe^{+++}$, $Zn^{++}$ and substituted ammonium. The term "substituted ammonium" refers to ammonium substituted with an alkyl or hydroxy alkyl radical having 1 to 4 carbon atoms. It is within the scope of this invention that the sulfonate salt is non-metallic and can be a nitrogen base as described in U.S. Pat. No. 4,304,901 which is incorporated herein by reference.

The choice of cation will influence the water dispersibility of the resulting sulfo-polyester. Monovalent alkali metal ions yield polyesters that are less readily dissipated by cold water and more readily dissipated by hot water, while divalent and trivalent metal ions result in sulfo-polyesters that are not ordinarily easily dissipated by cold water but are more readily dispersed in hot water. Depending on the end use of the polymer, either of the different sets of properties may be desirable. It is possible to prepare the sulfo-polyester using, for example, a sodium sulfonate salt and later by ion-exchange replace this ion with a different ion, for example, calcium, and thus alter the characteristics of the polymer. In general, this procedure is superior to preparing the polymer with divalent salts inasmuch as the sodium salts are usually more soluble in the polymer manufacturing components than are the divalent metal salts. Polymers containing divalent and trivalent metal ions are normally less elastic and rubber-like than polymers containing monovalent ions.

The difunctional sulfomonomer contains at least one sulfonate group attached to an aromatic nucleus wherein the functional groups are hydroxy, carboxy or amino. Advantageous difunctional sulfomonomer components are those wherein the sulfonate salt group is attached to an aromatic acid nucleus such as benzene, naphthalene, diphenyl, oxydiphenyl, sulfonyldiphenyl or methylenediphenyl nucleus. Examples of sulfomonomers include sulfophthalic acid, sulfoterephthalic acid, sulfoisophthalic acid, 5-sodiosulfoisophthalic acid, 4-sulfonaphthalene-2,7-dicarboxylic acid, and their esters. Metallosulfoaryl sulfonate which is described in U.S. Pat. No. 3,779,993, and is incorporated herein by reference, may also be used as a sulfomonomer.

The sulfomonomer is present in an amount to provide water-dispersibility to the sulfo-polyester. Preferably, the sulfomonomer is present in an amount of from 12 to 25 mole percent, more preferably 16 to 20 mole percent, based on the sum of the moles of total dicarboxylic acid content.

The diol component of the sulfo-polyester includes cycloaliphatic diols preferably having 6 to 20 carbon atoms or aliphatic diols preferably having 3 to 20 carbon atoms. Included within the class of aliphatic diols are aliphatic diols having ether linkages such as polydiols having 4 to 800 carbon atoms. Examples of diols are: ethylene glycol, propane-1,2-diol, 1,4-cyclohexanedimethanol, 2,2-dimethyl-1,3-propanediol, diethylene glycol, triethylene glycol, propane-1,3-diol, butane-1,4-diol, pentane-1,5-diol, hexane-1,6-diol, 3-methylpentanediol-(2,4), 2-methylpentanediol-(1,4), 2,2,4-trimethylpentane-diol-(1,3), 2-ethylhexanediol-(1,3), 2,2-diethylpropane-diol-(1,3), hexanediol-(1,3), 1,4-di-(hydroxyethoxy)-benzene, 2,2-bis-(4-hydroxycyclohexyl)-propane, 2,4-dihydroxy-1,1,3,3-tetramethyl-cyclobutane, 2,2-bis-(3-hydroxyethoxyphenyl)-propane, and 2,2-bis-(4-hydroxypropoxyphenyl)-propane. The sulfo-polyester may be prepared from two or more of the above diols.

The particular combination of diols is stipulated only by the requirements that the final product possess a Tg of 28° C. to 60° C. while maintaining water-dispersibility. Semi-crystalline and amorphous materials are within the scope of the present invention. It is to be understood that the sulfo-polyesters of this invention contain substantially equal molar proportions of acid equivalents (100 mole %) to hydroxy equivalents (100 mole %). Thus, the sulfo-polyester comprised of components (a), (b), and (c) will have a total of acid and hydroxyl equivalents equal to 200 mole percent. The sulfo-polyesters have an inherent viscosity of 0.1 to 1.0 dl/g, preferably 0.30 to 0.46 dl/g.

Preferably, the sulfo-polyester is derived from a mixture of dicarboxylic acids consisting of 75 to 90 mole percent isophthalic acid and 25 to 10 mole percent 5-sodio-sulfoisophthalic acid, and a diol component consisting of diethylene glycol. An equally preferred diol component consists of 45 to 85 mole percent diethylene glycol and 55 to 15 mole percent 1,4-cyclohexanedimethanol, based on 100 mole percent dicarboxylic acid and 100 mole percent diol.

Dispersal of the sulfo-polyester in water is preferably done at preheated water temperature of about a 65° C. to about 95° C. and the polymer added rapidly as pellets to the vortex under high shear stirring. A Cowles Dissolver, Waring Blender, or similar equipment may be used. Once water is heated to temperature, additional heat input is not required. Depending upon the volume prepared, dispersal of the pellets by stirring should be complete within 15 to 30 min. Continued agitation with cooling may be desirable to prevent thickening at the surface due to water evaporation.

The sulfo-polyesters can be prepared by conventional polycondensation procedures well-known in the art. Such processes include direct condensation of the acid with the diol or by ester interchange using lower alkyl esters. For example, a typical procedure consists of two stages. The first stage, known as ester interchange or esterification, is conducted in an inert atmosphere at a temperature of 175° C. to 240° C. for 0.5 to 8 hours, preferably 1 to 4 hours. The diols, depending on their particular reactivities and the specific experimental conditions employed, are commonly used in molar excesses of 1.05 to 2.5 per mole of difunctional sulfomonomer.

The second stage, referred to as polycondensation, is conducted under reduced pressure at a temperature of 230° C. to 350° C., preferably 265° C. to 325° C., and more preferably 270° C. to 290° C. for 0.1 to 6 hours, preferably 0.25 to 2 hours. Because high melt viscosities are encountered in the polycondensation stage, it is sometimes advantageous to employ temperatures above 300° C. since the resulting decrease in melt viscosity allows somewhat higher molecular weights to be obtained. Stirring or appropriate conditions are employed in both stages to ensure sufficient heat transfer and surface renewal for the reaction mixture. The reactions of both stages are facilitated by appropriate catalysts which are well known in the art. Suitable catalysts include, but are not limited to, alkoxy titanium compounds, alkali metal hydroxides and alcoholates, salts of organic carboxylic acids, alkyl tin compounds and metal oxides.

The complex phosphate ores that may be treated according to the present invention contain approximately an equal amount of phosphate, clay and silica along with other metal salts such as iron, aluminum and the like, mixed with gangue material. The phosphate to be beneficiated is desirably the so called Florida phosphate. The mined ore is scrubbed and sized in a manner known to the art. Generally, a phosphate ore fraction passed by 35 mesh, but not passed through 200 mesh is the fraction amenable to floating by the disclosed process. However, some small benefit is achieved in the flotation of particles larger than 35 mesh.

The washed and sized ore is mixed with sufficient water to prepare an aqueous slurry having a solids concentration of from 68 to 76 weight percent solids, preferably from 70 to 76 percent solids. The aqueous phosphate ore slurry is then conditioned by any conventional mixing means which is capable of uniformly mixing slurries of this high concentration. For example, the conditioning means can operably be a vertical mixing tank with a cruciform impeller or it may be a horizontal rotary drum with flights for lifting the feed.

During or prior to conditioning, an anionic flotation reagent consisting essentially of a fatty acid, a fuel oil, a pH adjusting compound and a sulfo-polyester are introduced into the aqueous phosphate ore slurry so as to effect during conditioning intimate contact of these reagents with substantially all of the ore. The fatty acid can be selected from the group consisting of oleic acid, linoleic acid, tall oils, rosin, mixtures thereof, and other like materials commonly used in anionic flotation reagents. The fatty acid should be introduced at a dosage of about 0.3 to about 2 pounds fatty acid per ton of ore.

The fuel oil can be selected from the group consisting of diesel oil, kerosene, Bunker C fuel oil, fuel oil No. 5, mixtures thereof and other like materials commonly used in anionic flotation reagents. The fuel oil can be introduced in a ratio from about 1:1 to about 8:1 by weight relative to the fatty acid.

The pH adjusting composition is utilized to adjust and maintain the pH of the phosphate slurry to a value from about 7.5 to about 10.5, preferably at least 9. The pH adjusting composition is preferably sodium hydroxide. Other alkaline materials are operable, such as soda ash, lime, ammonia, potassium hydroxide, magnesium hydroxide and the like. Some of the sulfo-polyester can also be used to slightly adjust the pH of the medium.

The sulfo-polyester introduced into the phosphate ore slurry is of the type previously described. This sulfo-polyester is introduced in a ratio preferably greater than 0.6 kilogram per metric ton of phosphate ore.

The order in which the aforementioned reagents are introduced into the aqueous phosphate slurry is not necessarily critical. However, it is recommended that the pH be adjusted before the addition of the other reagents. It is operable to add the sulfo-polyester to the slurry prior to, contemporaneous with or following the addition of the fatty acid and fuel oil. However, it is convenient to add the sulfo-polyester after the pH of the slurry is adjusted. In typical plant operation, several conditioning tanks connected in series, are used to provide proper retention time. Therefore, the above-identified reagents can be added in separate conditioning stages.

The conditioned phosphate ore slurry is then introduced into a flotation machine or bank of rougher cells where, typically after dilution, it is aerated to float the phosphate. Any suitable rougher flotation unit can be employed.

The practice of the method of the present invention can be used alone to beneficiate phosphate ore. The new process can be used as a one stage flotation operation, or it can be used in two or more stages. Batch or locked cycle flotation tests may be employed. In batch tests, several rougher flotation tests are conducted independently to generate enough rougher concentrate for subsequent processing involving acid scrubbing and cleaner flotation steps. Locked cycle flotation tests are continuous tests in which the phosphate recovered in the scavenger operation along with some silica is recycled back as feed to the rougher flotation circuit.

The materials and testing procedures used for the results shown herein are as follows:

Brookfield viscosity was determined according to ASTM D2196.

Inherent viscosity (I.V.) was determined according to ASTM D2857-70. The I.V. was measured at 25° C. using 0.25 grams of polymer per 100 ml of a solvent consisting of 60% by weight phenol and 40% by weight tetrachloroethane.

The water-dispersible sulfo-polyesters used in the examples are:

A. Sulfo-Polyester A was prepared as follows: A 500 mL round bottom flask equipped with a ground-glass head, an agitator shaft, nitrogen inlet and a side arm was charged with 74.0 grams of isophthalic acid, 16.0 grams of 5-sodiosulfoisophthalic acid, 106.0 grams of diethylene glycol, sufficient titanium isopropoxide to provide 50 ppm of titanium, and 0.45 grams of sodium acetate tetrahydrate. The flask was immersed in a Belmont bath at 200° C. for two hours under a nitrogen sweep. The temperature of the bath was increased to 280° C. and the flask was heated for one hour under reduced pressure of 0.5 to 0.1 mm of Hg. The flask was allowed to cool to room temperature and the copolyester was removed from the flask. The copolyester had an I.V. of about 0.42 and a glass transition temperature of about 29° C. as measured using a differential scanning calorimeter (DSC). The copolyester was extruded and pelletized.

A 28% solids dispersion of Sulfo-Polyester A in water was prepared by heating the water to a temperature of 75° C. to 85° C. and adding the required amount of pellets while agitating at a rate sufficient to maintain the pellets in suspension. The heating was continued until all the pellets were dispersed, approximately, 20 to 30 minutes. Water was added to replace evaporation loss. The dispersion was cooled and filtered.

B. Sulfo-Polyester B was prepared as follows: A 500 mL round bottom flask equipped with a ground-glass head, an agitator shaft, nitrogen inlet and a side arm was charged with 74.0 grams of isophthalic acid, 16.0 grams of 5-sodiosulfoisophthalic acid, 83.0 grams of diethylene glycol, 16.0 grams of 1,4-cyclohexane-dimethanol, sufficient titanium isopropoxide to provide 50 ppm of titanium, and 0.45 grams of sodium acetate tetrahydrate. The flask was immersed in a Belmont bath at 200° C. for one hour under a nitrogen sweep. The temperature of the bath was increased to 230° C. for one hour. The temperature of the bath was increased to 280° C. and the flask was heated for 45 minutes under reduced pressure of 0.5 to 0.1 mm of Hg. The flask was allowed to cool to room temperature and the copolyester was removed from the flask. The copolyester had an I.V. of about 0.36 and a glass transition temperature of about 38° C. as measured using a differential scanning calorimeter (DSC). The copolyester was extruded and pelletized.

A 28% solids dispersion of Sulfo-Polyester B in water was prepared by heating the water to a temperature of 90° C. to 95° C. and adding the required amount of pellets while agitating at a rate sufficient to maintain the pellets in suspension. The heating was continued until all the pellets were dispersed, approximately, 20 to 30 minutes. Water was added to replace evaporation loss. The dispersion was cooled and filtered.

C. Sulfo-Polyester C was prepared as follows: A 500 mL round bottom flask equipped with a ground-glass head, an agitator shaft, nitrogen inlet and a side arm was charged with 136.0 grams of isophthalic acid, 53.0 grams of 5-sodiosulfoisophthalic acid, 155.0 grams of diethylene glycol, 78.0 grams of 1,4-cyclohexane-dimethanol, sufficient titanium isopropoxide to provide 50 ppm of titanium, and 1.48 grams of sodium acetate tetrahydrate. The flask was immersed in a Belmont bath at 200° C. for one hour under a nitrogen sweep. The temperature of the bath was increased to 230° C. for one hour. The temperature of the bath was increased to 280° C. and the flask was heated for 45 minutes under reduced pressure of 1.5 to 0.1 mm of Hg. The flask was allowed to cool to room temperature and the copolyester was removed from the flask. The copolyester had an I.V. of about 0.33 and a glass transition temperature of about 55° C. as measured using a differential scanning calorimeter (DSC). The copolyester was extruded and pelletized.

A 28% solids dispersion of Sulfo-Polyester C in water was prepared by heating the water to a temperature of 85° C. to 90° C. and adding the required amount of pellets while agitating at a rate sufficient to maintain the pellets in suspension. The heating was continued until all the pellets were dispersed, approximately, 20 to 30 minutes. Water was added to replace evaporation loss. The dispersion was cooled and filtered.

The composition of Sulfo-Polyesters A, B and C are summarized as follows:

| Sulfo-Polyester | IPA Mole % | SIP Mole % | DEG Mole % | CHDM Mole % | I.V. | Tg |
|---|---|---|---|---|---|---|
| A | 89 | 11 | 100 | 0 | .42 | 29 |
| B | 89 | 11 | 78 | 22 | .36 | 38 |
| C | 82 | 18 | 34 | 46 | .33 | 55 |

The flotation feed samples were obtained from two phosphate mining sites in Florida. The samples were dried in an oven at 105° C. for 16 hours, sized to −35+150 mesh, and split into representative batches of 450 grams each. Size distribution of the feed samples was as follows.

Size Analysis of Flotation Feed (wt %)

| SAMPLE | +35 Mesh | −35 + 65 | −65 + 100 | −100 + 150 | −150 |
|---|---|---|---|---|---|
| 1 | 11.15 | 49.92 | 21.75 | 10.10 | 7.08 |
| 2 | 20.02 | 52.90 | 18.60 | 6.90 | 1.30 |

The chemical composition of Feeds 1 and 2 was determined to be:

| FEEDS | Assay, % $P_2O_5$ | Insol |
|---|---|---|
| 1 | 9.28 | 67.4 |
| 2 | 10.18 | 63.2 |

The Froth Flotation Process steps used in the Examples was as follows:

In Step (I), a slurry of 72 weight percent pulp density was prepared using 450 grams of −35+150 mesh feed and 175 milliliters of tap water. The mixture was agitated at 768 rpm for one minute. The pH was determined to be 8.3. The slurry was agitated for one minute, Westvaco M28B and Fuel Oil No. 5, which are available from Westvaco, Inc., were added and agitation was continued for three minutes. The pulp pH was maintained at 8.4±0.2 throughout Step (I). After conditioning, the pulp was transferred to a 1.25 liter flotation cell and diluted to 31% solids with tap water. The pH was determined to be 8.3. The suspension was agitated at 1100 rpm for one minute, the air was turned on (35 liters/min) and the froth removed until barren. After the froth was skimmed, the froth and sink fractions were dried, weighed, and analyzed for $P_2O_2$ and acid insolubles (silica).

In Step (II), the rougher concentrate was transferred to a 1.7 liter octagonal conditioning vessel with about 1500 milliliters of water to yield a pulp density of 20 weight percent. The slurry pH was adjusted to 3.5 with a 2% sulfuric acid solution and agitated at 768 rpm for 30 minutes. After scrubbing, the rougher concentrate was washed until the pH of the slurry was approximately 7.

In Step (III), the scrubbed and washed rougher concentrate was transferred into a flotation cell. The pH of the slurry (25 weight percent) was adjusted to 7.1. A given amount of fatty amine solution was added and the slurry was agitated at 1100 rpm for 30 minutes. The air intake valve was opened and the silica was skimmed off until froth was barren.

The process of the present invention will be further illustrated by a consideration of the following examples, which are intended to be exemplary of the invention. All parts and percentages in the examples are on a weight basis unless otherwise stated.

EXAMPLE 1

The froth flotation process, described above, was conducted using Feed 2. No sulfo-polyester was added. The collector dosage was 1.2 kg/ton. Flotation test results are summarized in Table I and mass balance for various cycles is summarized in Table II.

The results in Table I for Example 1 indicates that the recovery of phosphate values is similar to the conventional batch process flotation scheme (31–34%) without the addition of a sulfo-polyester. The grade of the concentrate, however, is lower in the locked cycle flotation than in conventional flotation.

EXAMPLE 2

The above-described Froth Flotation Process was followed except in Step (I), 0.66 kg/ton of Sulfo-polyester A was added after an initial one minute agitation of 72 weight percent slurry at pH 8.3, prior to addition of the Westvaco M28B and Fuel Oil #5 collector. Flotation test results are summarized in Table I. Mass balance for various cycles is summarized in Table II.

The results in Table I for Example 2 indicate a decrease in concentrate grade as compared to conventional flotation results (31–34%) while phosphate recovery remained the same.

EXAMPLE 3

Example 2 was repeated except that the collector dosage was 1.0 kg/ton instead of 1.2 kg/ton. Flotation test results are summarized in Table I. Mass balance for various cycles is summarized in Table II.

The results in Table I for Example 3 indicate a further decrease in concentrate grade with an increase in recovery as compared to Example 2 which had a higher collector dosage.

EXAMPLE 4

Example 2 was repeated except that Sulfo-polyester B was used instead of Sulfo-polyester A. Flotation test results are summarized in Table I. Mass balance for various cycles is summarized in Table II.

The results in Table I for Example 4 indicate that after three cleaning stages both recovery and grade are higher than either with the conventional flotation scheme or with using Sulfo-polyester A in locked cycle flotation of phosphate ores.

EXAMPLE 5

Example 4 was repeated except that two cleaning steps were employed instead of three cleaning steps. Flotation test results are summarized in Table I. Mass balance for various cycles is summarized in Table II.

The results in Table I for Example 5 indicate that after two cleaning stages the grade is lower but the recovery is similar as compared to Example 4 where three cleaning stages were used.

EXAMPLE 6

Example 4 was repeated except that Sulfo-polyester C and a collector dosage of 0.8 kg/ton were used instead of Sulfo-polyester B and collector dosage of 0.6 kg/ton. Flotation test results are summarized in Table I. Mass balance for various cycles is summarized in Table II.

The results in Table I for Example 6 indicate that Sulfo-polyester C is as effective as Sulfo-polyester B but at a lower collector dosage.

EXAMPLE 7

Example 5 was repeated except that Sulfo-polyester C was used instead of Sulfo-polyester B. Locked cycle flotation tests with Feed I were conducted. Flotation test results are summarized in Table I. Mass balance for various cycles is summarized in Table II.

The results in Table I for Example 7 indicate that at a collector dosage of 0.88 kg/ton, Sulfo-polyester C yields the greatest separation as compared to any of the above examples.

TABLE I

| | Locked Cycle Flotation | | |
|---|---|---|---|
| | Acid Analysis | | |
| Sample | Grade (% $P_2O_5$) | Insols ($SiO_2$) (%) | Recovery (%) |
| Example 1 | | | |
| Feed | 10.18 | 63.2 | 100 |
| Concentrate | 30.64 | 6.3 | 95.1 |
| Example 2 | | | |
| Feed | 10.18 | 63.2 | 100 |
| Concentrate | 30.17 | 6.2 | 95.3 |
| Example 3 | | | |
| Feed | 10.18 | 63.2 | 100 |
| Concentrate | 28.42 | 7.9 | 96.8 |
| Example 4 | | | |
| Feed | 10.18 | 63.2 | 100 |
| Concentrate | 32.39 | 3.8 | 96.9 |
| Example 5 | | | |
| Feed | 10.18 | 63.2 | 100 |
| Concentrate | 30.51 | 6.6 | 95.9 |
| Example 6 | | | |
| Feed | 10.18 | 63.2 | 100 |
| Concentrate | 30.51 | 6.6 | 95.9 |
| Example 7 | | | |
| Feed | 9.28 | 67.40 | 100 |
| Concentrate | 34.25 | 2.64 | 95.8 |

TABLE II

| | Mass Balance | | |
|---|---|---|---|
| Cycle No. | Fresh Feed (g) | Conc. (g) | Tailings (g) |
| Example 1 | | | |
| 1 | 450 | 110.1 | 284.8 |
| 2 | 410 | 120.7 | 267.4 |
| 3 | 410 | 116.3 | 277.9 |
| Example 2 | | | |
| 1 | 450 | 113.3 | 281.2 |
| 2 | 410 | 120.8 | 274.7 |
| 3 | 410 | 119.4 | 280.3 |
| Example 3 | | | |
| 1 | 450 | 83.9 | 280.7 |
| 2 | 410 | 98.4 | 283.9 |
| 3 | 410 | 96.0 | 298.4 |
| Example 4 | | | |
| 1 | 450 | 111.3 | 293.9 |
| 2 | 410 | 137.6 | 260.5 |
| 3 | 410 | 122.7 | 275.5 |
| Example 5 | | | |
| 1 | 450 | 94.8 | 287.3 |
| 2 | 410 | 135.0 | 264.2 |
| 3 | 410 | 115.3 | 284.1 |
| Example 6 | | | |
| 1 | 450 | 94.8 | 287.3 |
| 2 | 410 | 135.0 | 264.2 |
| 3 | 410 | 115.3 | 284.1 |
| Example 7 | | | |
| 1 | 450 | 93.1 | 311.6 |
| 2 | 410 | 104.5 | 308.4 |
| 3 | 410 | 109.1 | 300.0 |

EXAMPLE 8

This example illustrates the comparison of locked cycle data in the presence of Sulfo-polyesters A, B and C and using Feed 2. The test results are summarized in Table III.

TABLE III

| Sulfo-polyester | Collector Dosage (Kg/t) | Grade (% $P_2O_5$) | Recovery (%) |
|---|---|---|---|
| Locked Cycle Flotation | | | |
| Sulfo-polyester A | 1.2 | 30.17 | 95.3 |
| Sulfo-polyester B | 1.2 | 32.39 | 96.9 |
| Sulfo-polyester C | 0.8 | 32.29 | 95.1 |
| Conventional Flotation | | | |
| No Sulfo-polyester | 1.2 | 31.63 | 95.4 |

The results in Table III indicates that in locked cycle tests, considering the dosage of the collector, Sulfo-polyester C having a Tg of 55° C. was superior to Sulfo-polyesters A and B. Comparison of results of conventional flotation without a sulfo-polyester and locked cycle flotation with Sulfo-polyester C indicates that a higher grade at comparable recovery was obtained with 33% less collector when Sulfo-polyester C was used.

EXAMPLE 9

Batch flotation tests using Feed 1 were conducted following the procedure described above. The collector dosage employed was 1.2 kg/ton of the (50:50) fatty acid fuel oil mixture in the rougher flotation stage and 0.23 kg/ton of fatty amine in the cleaner circuit. The test results are summarized in Table IV.

The results in Table IV indicate that following the conventional scheme, Feed 1 was upgraded from 9.28% $P_2O_5$ to 32.31% $P_2O_5$ at a recovery level of 91.4% which indicates good separation of silica and phosphate particles with the use of a sulfo-polyester.

EXAMPLE 10

Example 9 was repeated except that Feed 2 was used instead of Feed 1. The test results are summarized in Table IV.

The results in Table IV indicate that Feed 2 can also be beneficated using the conventional flotation scheme.

EXAMPLE 11

Example 10 was repeated except that the collector dosage used was 1 kg/ton instead of 1.2 kg/ton of the ore.

The results in Table IV indicate that while the phosphate recovery is similar, the grade is lower as compared to Example 10 wherein the collector dosage was 1.2 kg/ton.

EXAMPLE 12

Example 11 was repeated except that 0.66 kg/ton of Sulfo-polyester C was added to Feed 2 prior to a collector addition of 0.8 kg/ton. The test results are summarized in Table IV.

The results in Table IV indicate that one-third less collector was needed when Sulfo-polyester C was used as compared to when Sulfo-polyesters A and B were used.

TABLE IV

| | Batch Flotation | | |
|---|---|---|---|
| | Acid Analysis | | |
| Sample | Grade (% $P_2O_5$) | Insols ($SiO_2$) (%) | Recovery (%) |
| Example 9 | | | |
| Feed | 9.28 | 67.4 | 100 |
| Concentrate | 32.31 | 2.8 | 91.4 |
| Example 10 | | | |
| Feed | 10.18 | 63.2 | 100 |

TABLE IV-continued

| | Batch Flotation | | |
|---|---|---|---|
| | Acid Analysis | | |
| Sample | Grade (% $P_2O_5$) | Insols ($SiO_2$) (%) | Recovery (%) |
| Concentrate | 31.63 | 4.2 | 95.4 |
| Example 11 | | | |
| Feed | 10.18 | 63.2 | 100 |
| Concentrate | 29.26 | 7.4 | 94.1 |
| Example 12 | | | |
| Feed | 10.18 | 63.2 | 100 |
| Concentrate | 31.25 | 3.9 | 90.90 |

EXAMPLE 13

Rougher flotation tests using Sulfo-polyester A were conducted at collector dosage of 1.0 kt/ton. In these tests, the collector was added at different stages of the flotation process. The results are summarized in Table V.

The results in Table V indicate that optimum phosphate recovery was obtained using Sulfo-polyester A at a dosage of 0.66 kg/ton.

TABLE V

| Sulfo-polyester A Dosage, (kg/ton) | Fractions | Weight (g) | Grade (% $P_2O_5$) | Recovery (%) |
|---|---|---|---|---|
| 0 | Froth I | 132.4 | 28.13 | |
| | Froth II | 16.8 | 21.31 | 92.7 |
| | Tailings | 296.9 | 1.03 | |
| 0.17 | Froth I | 113.9 | 29.38 | |
| | Froth II | 29.5 | 25.69 | 91.8 |
| | Tailings | 303.0 | 1.23 | |
| 0.33 | Froth I | 103.3 | 30.73 | |
| | Froth II | 34.1 | 25.21 | 91.0 |
| | Tailings | 307.1 | 1.31 | |
| 0.66 | Froth I | 124.4 | 29.31 | |
| | Froth II | 22.7 | 24.37 | 95.0 |
| | Tailings | 298.4 | 1.06 | |

EXAMPLE 14

Example 13 was repeated except that Sulfo-polyester B was used and the collector was added in one step. The test results are summarized in Table VI.

The results in Table VI indicate that optimum phosphate recovery was obtained using Sulfo-polyester B at a dosage of 0.66 kg/ton.

TABLE VI

| Sulfo-polyester B Dosage, (kg/ton) | Fractions | Weight (g) | Grade (% $P_2O_5$) | Recovery (%) |
|---|---|---|---|---|
| 0 | Concentrate | 126.2 | 27.49 | 86.2 |
| | Tailings | 320.5 | 1.73 | |
| 0.17 | Concentrate | 136.5 | 26.08 | 87.4 |
| | Tailings | 310.1 | 1.66 | |
| 0.33 | Concentrate | 139.2 | 27.49 | 89.8 |
| | Tailings | 307.4 | 1.41 | |
| 0.66 | Concentrate | 143.2 | 26.01 | 90.4 |
| | Tailings | 304.0 | 1.30 | |
| 1.0 | Concentrate | 155.2 | 24.72 | 92.4 |
| | Tailings | 292.6 | 0.93 | |

EXAMPLE 15

This example examines the effect of various sulfo-polyesters on phosphate flotation. The test results are summarized in Table VII.

TABLE VII

| Polymer | Rougher Conc. Grade (% $P_2O_5$) | Recovery (%) |
|---|---|---|
| Sulfo-polyester A | 26.66 | 89.4 |
| Sulfo-polyester B | 26.01 | 90.4 |
| Sulfo-polyester C | 28.16 | 93.8 |

The results in Table VII indicate that Sulfo-polyester C having a Tg of 55° C. outperforms Sulfo-polyesters A and B having Tg's of 29° C. and 38° C., respectively, both in the $P_2O_5$ grade and phosphate recovery.

Many variations will suggest themselves to those skilled in this art in light of the above detailed description. All such obvious modifications are within the full intended scope of the appended claims.

What is claimed is:

1. In a process for beneficiating a silicious phosphate ore by flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a water dispersible sulfo-polyester having a glass transition temperature of 28° C. to 60° C., said sulfo-polyester consisting essentially of repeat units from:

(a) a dicarboxylic acid selected from the group consisting of aromatic dicarboxylic acids, saturated aliphatic dicarboxylic acids, cycloaliphatic dicarboxylic acids, and combinations thereof;

(b) a diol; and (c) a difunctional sulfomonomer containing at least one sulfonate group attached to an aromatic nucleus wherein the functional groups are hydroxy, carboxy or amino, provided the difunctional sulfomonomer is present in an amount from 12 to 25 mole percent based on 100 mole percent dicarboxylic acid and 100 mole percent diol.

2. In a process for beneficiating a silicious phosphate ore by flotation, the process comprising the steps of conditioning an aqueous slurry of phosphate ore at a pH of from 7.5 to 10.5 with a fatty acid and a fuel oil and aerating the conditioned phosphate slurry to float the phosphate, the improvement comprising conditioning the aqueous phosphate slurry prior to aeration with a water dispersible sulfo-polyester having a glass transition temperature of 50° C. to 60° C., said sulfo-polyester consisting essentially of repeat units from:

(a) a dicarboxylic acid selected from the group consisting of terephthalic acid, phthalic acid, isophthalic acid, naphthalene-2,6-dicarboxylic acid, cyclohexanedicarboxylic acid, cyclohexanediacetic acid, and combinations thereof;

(b) a diol selected from the group consisting of ethylene glycol, diethylene glycol, triethylene glycol, 1,4-cyclohexanedimethanol, and combinations thereof; and (c) a difunctional sulfomonomer selected from the group consisting of sulfophthalic acid, sulfoterephthalic acid, sulfoisophthalic acid, 4-sulfonaphthalene-2,7-dicarboxylic acid, and esters thereof, provided the difunctional sulfomonomer is present in an amount from 12 to 25 mole percent based on 100 mole percent dicarboxylic acid and 100 mole percent diol.

3. The process of claim 1 wherein the aqueous phosphate slurry is conditioned with greater than 0.60 kilograms of sulfo-polyester per ton of phosphate ore.

4. The process of claim 3 wherein the aqueous phosphate slurry is conditioned with greater than 1.0 kilogram of sulfo-polyester per ton of phosphate ore.

5. The process of claim 1 wherein the sulfo-polyester has a glass transition temperature of 53° C. to 57° C.

6. The process of claim 2 wherein the aqueous phosphate slurry is conditioned with greater than 0.60 kilograms of sulfo-polyester per ton of phosphate ore.

7. The process of claim 6 wherein the aqueous phosphate slurry is conditioned with greater than 1.0 kilogram of sulfo-polyester per ton of phosphate ore.

8. The process of claim 2 wherein the sulfo-polyester has a glass transition temperature of 53° C. to 57° C.

9. The process of claim 1 wherein the sulfo-polyester has an inherent viscosity of 0.1 to 1.0 deciliters/gram.

10. The process of claim 9 wherein the sulfo-polyester has an inherent viscosity of 0.28 to 0.35 dl/g.

11. The process of claim 2 wherein the sulfo-polyester has an inherent viscosity of 0.1 to 1.0 deciliters/gram.

12. The process of claim 11 wherein the sulfo-polyester has a inherent viscosity of 0.28 to 0.35 dl/g.

13. The process of claim 1 wherein the dicarboxylic acid component of the sulfo-polyester is selected from the group consisting of terephthalic acid, phthalic acid, isophthalic acid, naphthalene-2,6-dicarboxylic acid, cyclohexanedicarboxylic acid, cyclohexanediacetic acid, and mixtures thereof.

14. The process of claim 13 wherein the dicarboxylic acid component is isophthalic acid.

15. The process of claim 1 wherein the diol component of the sulfo-polyester is selected from the group consisting of ethylene glycol, diethylene glycol, triethylene glycol, 1,4-cyclohexanedimethanol, and mixtures thereof.

16. The process of claim 15 wherein the diol component is a mixture of diethylene glycol and 1,4-cyclohexanedimethanol.

17. The process of claim 1 wherein the difunctional sulfomonomer component of the sulfo-polyester is selected from the group consisting of sulfophthalic acid, sulfoterephthalic acid, sulfoisophthalic acid, 4-sulfonaphthalene-2,7-dicarboxylic acid, and esters thereof.

18. The process of claim 17 wherein the difunctional sulfomonomer is 5-sodio-sulfoisophthalic acid.

19. The process of claim 1 wherein the sulfo-polyester has repeat units from isophthalic acid, diethylene glycol and 1,4-cyclohexanedimethanol, and 5-sodio-sulfoisophthalic acid.

* * * * *